US009073363B1

(12) United States Patent
Sekino et al.

(10) Patent No.: US 9,073,363 B1
(45) Date of Patent: Jul. 7, 2015

(54) ADDITIONAL CONVEYANCE MECHANISM OF PRINTER APPARATUS AND PRINTER APPARATUS

(71) Applicant: TOSHIBA TEC KABUSHIKI KAISHA, Shinagawa-ku, Tokyo (JP)

(72) Inventors: Toshiharu Sekino, Shizuoka-ken (JP); Tsuyoshi Sanada, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/156,786

(22) Filed: Jan. 16, 2014

(51) Int. Cl.
*B41J 11/00* (2006.01)
*B41J 11/04* (2006.01)

(52) U.S. Cl.
CPC ..... *B41J 11/0045* (2013.01); *B41J 11/04* (2013.01)

(58) Field of Classification Search
USPC ..... 347/211, 213–215, 217–219, 222, 16, 347/101, 104, 171; 400/611, 613, 618, 621, 400/621.1; 271/3.14, 3.18, 3.2; 358/1.2
See application file for complete search history.

(56) References Cited

U.S. PATENT DOCUMENTS

| | | | | |
|---|---|---|---|---|
| 7,830,404 | B2 * | 11/2010 | Yamada | 347/171 |
| 8,885,002 | B2 * | 11/2014 | Wright et al. | 347/171 |
| 2005/0281606 | A1 | 12/2005 | Koyama et al. | |
| 2011/0157292 | A1 * | 6/2011 | Gunabalan et al. | 347/215 |
| 2011/0216149 | A1 * | 9/2011 | Masuda | 347/218 |
| 2011/0272934 | A1 * | 11/2011 | Lundgren et al. | 347/171 |
| 2013/0258023 | A1 * | 10/2013 | Sekino et al. | 347/104 |

FOREIGN PATENT DOCUMENTS

| | | |
|---|---|---|
| JP | 2008-006680 | 1/2008 |
| JP | 2010-167578 | 8/2010 |

* cited by examiner

*Primary Examiner* — Kristal Feggins
(74) *Attorney, Agent, or Firm* — Amin, Turocy & Watson, LLP

(57) ABSTRACT

An additional conveyance mechanism of a printer, a first printing section, and a second printing section, wherein the additional conveyance mechanism of the printer apparatus comprises: a second paper conveyance path configured to convey papers having only one printing surface in which side it is merged with the first paper conveyance path between the first printing section and the second printing section, and a separation mechanism configured to separate the thermal printing head carrying out no printing from the platen roller in the contacted thermal printing heads and platen rollers when the papers loaded in the printer apparatus and the additional conveyance mechanism of the printer apparatus are printed.

3 Claims, 6 Drawing Sheets

FIG.5(a)
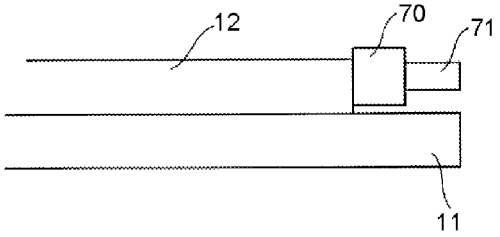
FIG.5(b)
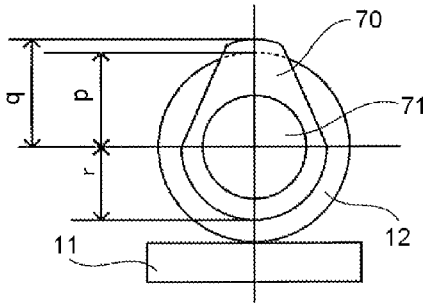
FIG.6
| | PAPER LOADED IN PRINTER APPARATUS | PAPER LOADED IN SECOND CONVEYANCE SECTION |
|---|---|---|
| MODE A | DOUBLE-SIDED PAPER(PAPER 3) | SINGLE-SIDED PAPER(PAPER 31) |
| MODE B | SINGLE-SIDED PAPER(PAPER 72) | SINGLE-SIDED PAPER(PAPER 31) |

ADDITIONAL CONVEYANCE MECHANISM OF PRINTER APPARATUS AND PRINTER APPARATUS

FIELD

Embodiments described herein relate to a printer apparatus which carries out printing on paper and issues the paper.

BACKGROUND

In a printer apparatus used as an apparatus for issuing, for example, a receipt, after prescribed items are printed on elongated paper drawn from paper wound in the rolled shape, the printed paper is cut into pieces of paper with a given length and then discharged.

It is known that such printer apparatuses include a double-sided thermal printer which carries out printing on both the surface and the back of paper so as to reduce the amount of paper used.

A thermosensitive layer which generates a color when heated is set on both the surface and the back of the paper used in a double-sided thermal printer apparatus, however, the paper used by the double-sided thermal printer apparatus, that is, double-sided thermal paper, is more expensive than single-sided thermal paper which has a thermosensitive layer only on one side.

In terms of economic, it is not preferable to carry out printing only on one side of the papers used for a double-sided thermal printer apparatus as it is expensive. Thus, it is considered to load a printer apparatus with both double-sided thermal paper and single-sided thermal paper.

However, the main body of a printer apparatus becomes large if the printer apparatus is always loaded with both double-sided thermal paper and single-sided thermal paper. It is further considered to set a paper loading section at one position so that double-sided paper and single-sided paper can be alternatively loaded every time when a printing job is carried out. However, it is troublesome to load paper alternatively every time when a printing job is carried out. Further, in a single-sided printing, the printing head at a non-use side is normally contacted with a platen roller and the service life of the printing head may be shortened due to the friction with the platen roller.

BRIEF DESCRIPTION OF THE DRAWINGS

FIG. 5 is a diagram illustrating a constitution of main portions of a separation mechanism for a thermal printing head section and a platen roller involved in the embodiment;

FIG. 6 is a category illustration condition table of the papers loaded in a printer apparatus and a second conveyance section involved in the embodiment;

DETAILED DESCRIPTION

An additional conveyance mechanism of a printer apparatus is carried on a printer apparatus comprising a first paper conveyance path configured to convey paper having printing surfaces on a first surface and a second surface serving as the backside of the first surface, a first printing section having a thermal printing head for carrying out printing on the first surface and a platen roller contacted with the thermal printing head, and a second printing section which is arranged at the downstream side of the paper conveyance direction of the first printing section having a thermal printing head for carrying out printing on the second surface and a platen roller contacted with the thermal printing head, wherein the additional conveyance mechanism of the printer apparatus comprises a second paper conveyance path configured to convey papers having only one printing surface in which side it is merged with the first paper conveyance path between the first printing section and the second printing section, and a separation mechanism configured to separate the thermal printing head carrying out no printing from the platen roller in the contacted thermal printing heads and the platen rollers when the papers loaded in the printer apparatus and the additional conveyance mechanism of the printer apparatus are printed.

The printer apparatus involved in embodiments described herein is described below in detail with reference to accompanying drawings. Moreover, in the printer apparatus 1, as paper is conveyed from the right side to the left side shown in FIG. 1, the right side shown in FIG. 1 is referred to as an upstream side and the left side shown in FIG. 1 is referred to as a downstream side in the following description.

Figure 1:
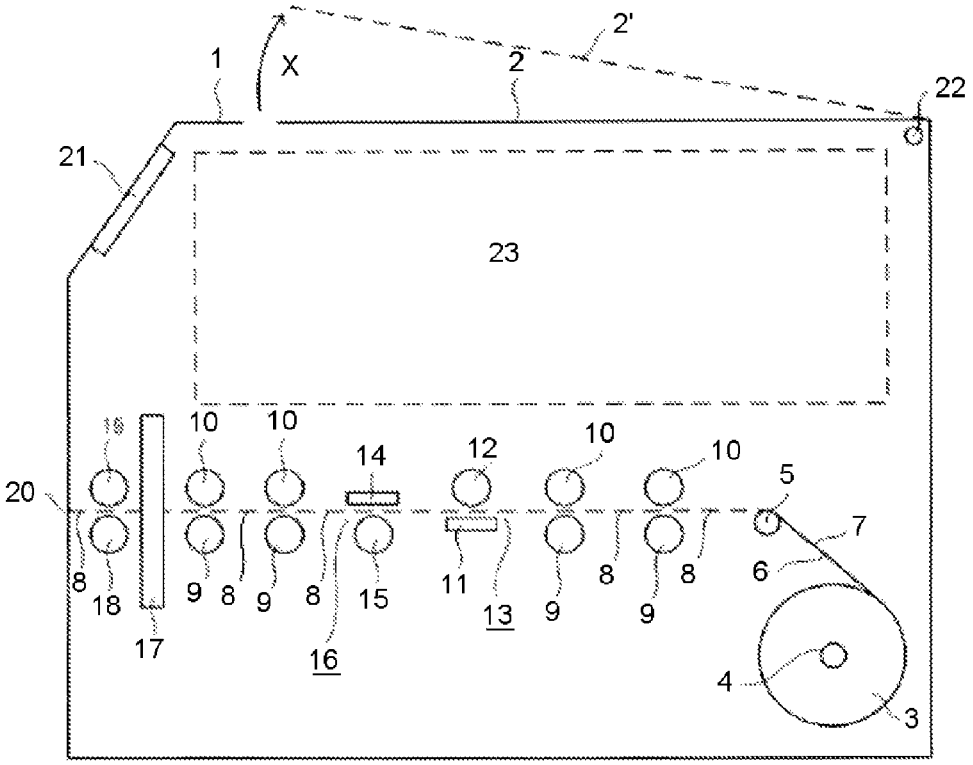
FIG. 1 is a diagram illustrating a constitution of main portions of a printer apparatus involved in an embodiment.

FIG. 1 is a constitution diagram illustrating the main portions of the printer apparatus 1 involved in embodiments described herein.

Paper 3 is loaded in the printer apparatus 1. The paper 3 is wound in the rolled shape on a winding shaft 4 which can be rotationally supported on a frame not shown arranged in the printer apparatus 1.

The paper 3 has a first paper surface 6 and a second paper surface 7 serving as the opposite surface, both of which have a thermosensitive layer that generates a color when heated.

An idler roller 5 is rotationally supported at the downstream side of the paper 3.

The printer apparatus 1 is provided with a paper discharging port 20 for discharging printed paper to the outside of the printer apparatus 1 and a first paper conveyance path 8 for conveying paper from the idler roller 5 to the paper discharging port 20.

A plurality of conveyance rollers rotated by a motor not shown are arranged at the downstream side of the idler roller 5, and a plurality of idler rollers 10 are arranged opposite to the conveyance rollers 9 across the first paper conveyance path 8.

A first thermal printing head 11 is arranged at the downstream side of the idler roller 5, and a first platen roller 12 rotated by a motor not shown is arranged opposite to the first thermal printing head 11 across the first paper conveyance path 8. The first thermal printing head 11 and the first platen roller 12 constitute a first printing section 13 which prints on the first paper surface 6 of the paper 3.

A second thermal printing head 14 is arranged at the downstream side of the first printing section 13, and a second platen roller 15 rotated by a motor not shown is arranged opposite to the second thermal printing head 14 across the first paper conveyance path 8. The second thermal printing head 14 and the second platen roller 15 constitute a second printing section 16 which prints on the second paper surface 7 of the paper 3.

A cutter 17 is arranged at the downstream side of the second printing section 16. The cutter 17 has a fixed blade not shown and a movable blade not shown which slides towards the fixed blade under the drive of a cutter motor not shown to cut off the paper 3 and the paper 31 which will be described later inserted in the slit not shown arranged in the cutter 17.

Here, the cutter 17 is described as the so-called slide type cutter which has a movable blade moving towards a fixed blade, however, the present invention is not limited to this case; the cutter 17 may also be the so-called rotary type cutter which cuts off papers through the rotational of a movable blade with respect to a fixed blade.

A discharging roller 18 rotated by a motor not shown is arranged at the downstream side of the cutter 17, and a discharging idler roller 19 is arranged opposite to the discharging roller 18 across the first paper conveyance path 8. At the downstream side of the discharging roller 18, the printer apparatus 1 has a paper discharging port 20, the paper 3 and the paper 31 which will be described later printed and cut off by the cutter 17 are discharged from the paper discharging port 20 to the outside of the printer apparatus 1. Further, the printer apparatus 1 has a display section 21 for displaying various kinds of information including error information of the printer apparatus 1.

The printer apparatus 1 has a cover 2, and a rotary shaft 22 is arranged on the upper end of the cover 2. In this way, the cover 2 can be rotated in the X direction shown in FIG. 1 to the position 2' shown in FIG. 1 and the like.

A second conveyance space section 23 is arranged above the first paper conveyance path 8 of the printer apparatus 1, and a second conveyance section 30 which will be described later is loaded in the second conveyance space section 23. Further, the cover 2 may be closed or opened completely when the second conveyance section 30 is loaded.

Figure 2:
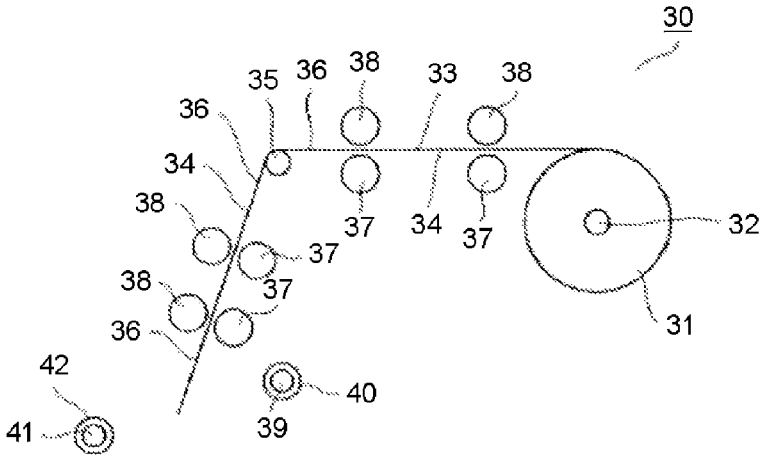
FIG. 2 is a diagram illustrating a constitution of main portions of a second conveyance section involved in the embodiment.

FIG. 2 is a diagram illustrating a constitution of main portions of the second conveyance section 30. The second conveyance section 30 may be attached to or detached from the printer apparatus 1 in such a manner that the second conveyance section 30 is integrated with the conveyance section and paper. Further, the second conveyance section 30, when arranged on the upper part of the printer apparatus 1, is easily attached to or detached from the printer apparatus 1. Further, it is likely that the paper 31 loaded in the second conveyance section 30 has a large diameter when compared with the paper 3 and the paper 72 loaded in the printer apparatus 1.

When desiring to carry out a single-sided printing using the printer apparatus 1 which is capable of printing on two surfaces, that is, the first paper surface 6 and the second paper surface 7, of the paper 3, the user loads the second conveyance space section 23 of the printer apparatus 1 with the second conveyance section 30 shown in FIG. 2.

The paper 31 is loaded in the second conveyance section 30. The paper 31 is wound in the rolled shape on a winding shaft 32 which can be rotationally supported on a frame not shown arranged in the second conveyance section 30.

The paper 31 has a third paper surface 33 and a fourth paper surface 34 serving as an opposite surface, wherein only the third paper surface 33 has a thermosensitive layer that generates a color when heated.

An idler roller 35 is rotationally supported at the downstream side of the paper 31.

A second paper conveyance path 36, which is connected to the first paper conveyance path 8 between the first printing section 13 and the second printing section 16 in the printer apparatus 1 from a loading section for the paper 31, is arranged in the second conveyance section 30. Further, a plurality of conveyance rollers 37 and idler rollers 38 which can be rotated by a motor not shown are arranged across the second paper conveyance path 36.

A first contact/separation motor 40 having a first contact/separation gear 39 and a second contact/separation motor 42 having a second contact/separation gear 41 are arranged in the second conveyance section 30. The first contact/separation gear 39 and the second contact/separation gear 41 of the second conveyance section 30 have a function of separating the thermal printing head at the side of the printing section on which no printing is carried out from a platen roller when single-sided paper is used.

Figure 3:
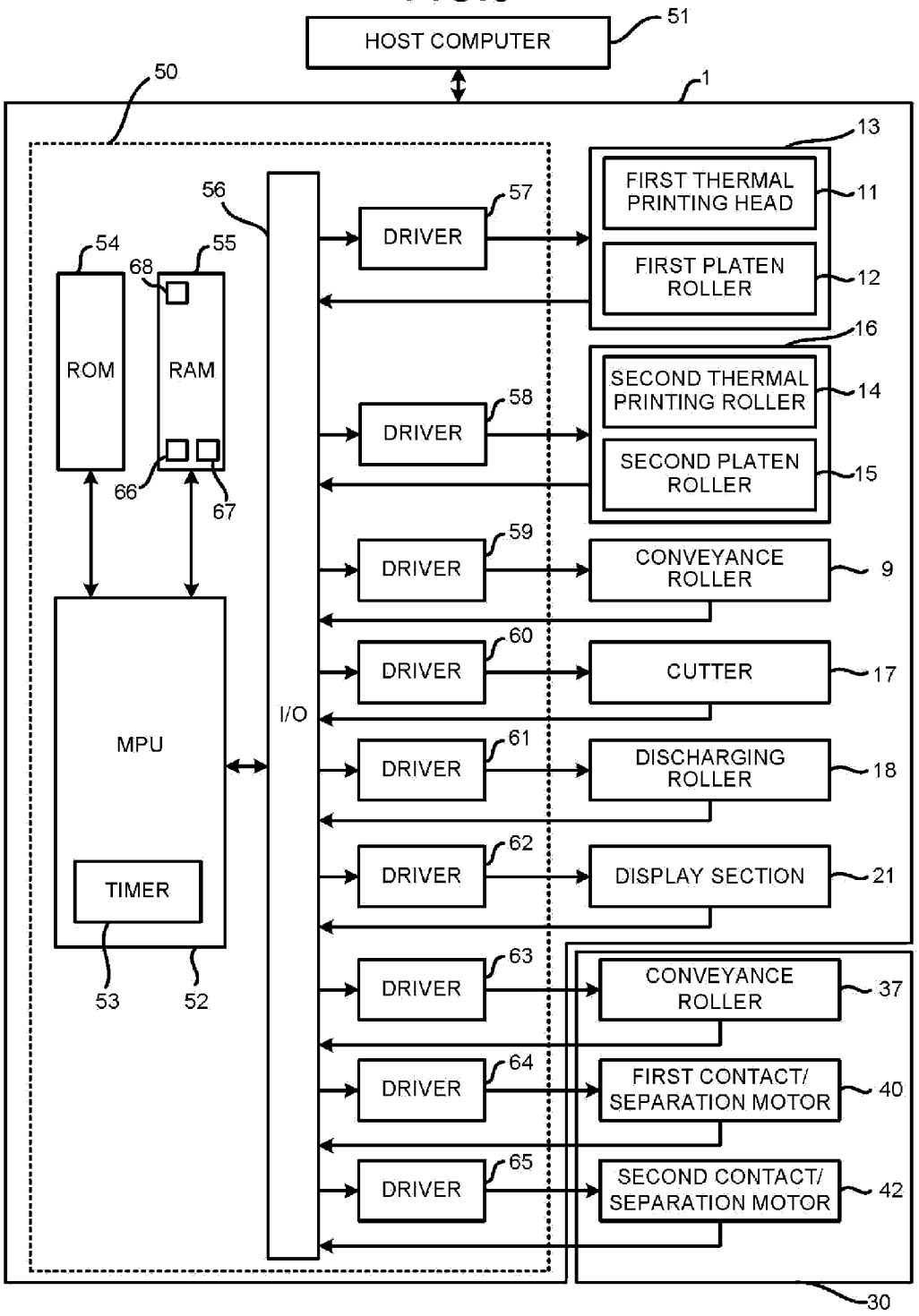
FIG. 3 is a control block diagram illustrating a state in which the second conveyance section is carried on the printer apparatus involved in the embodiment.
Figure 4:
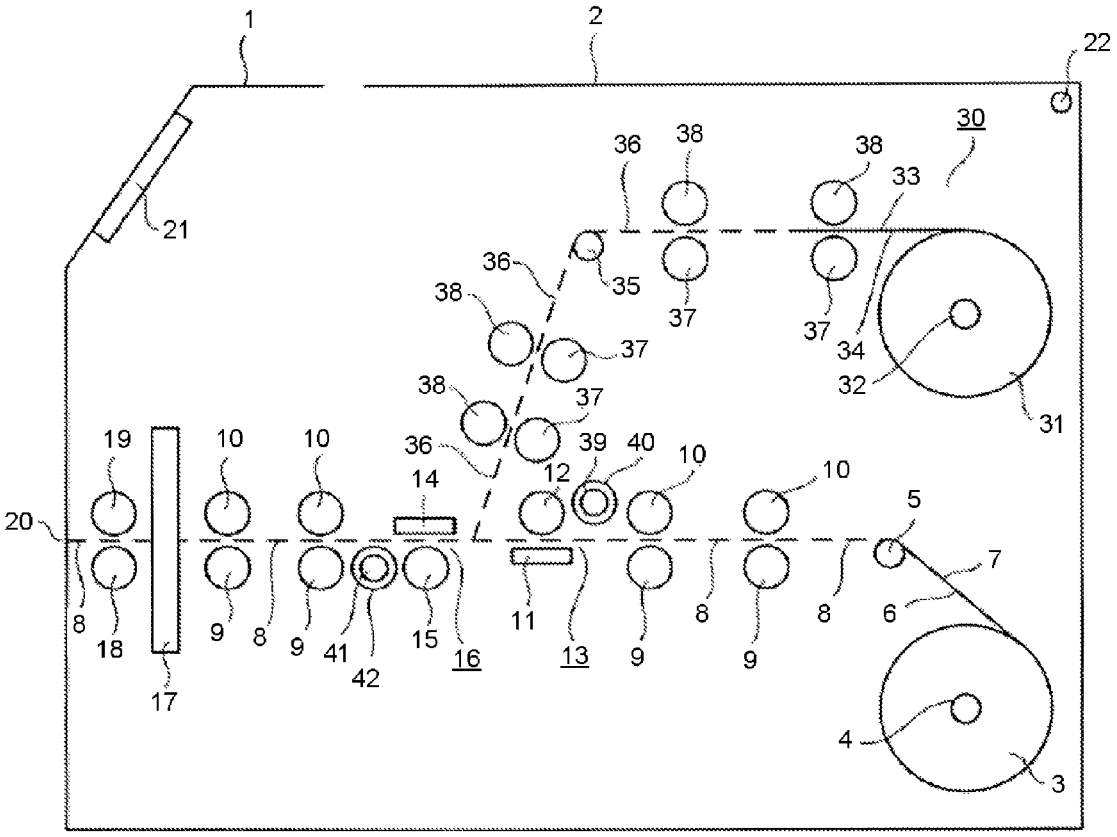
FIG. 4 is a diagram illustrating a constitution of main portions of a printer apparatus carrying a second conveyance section involved in the embodiment.
Figure 7:
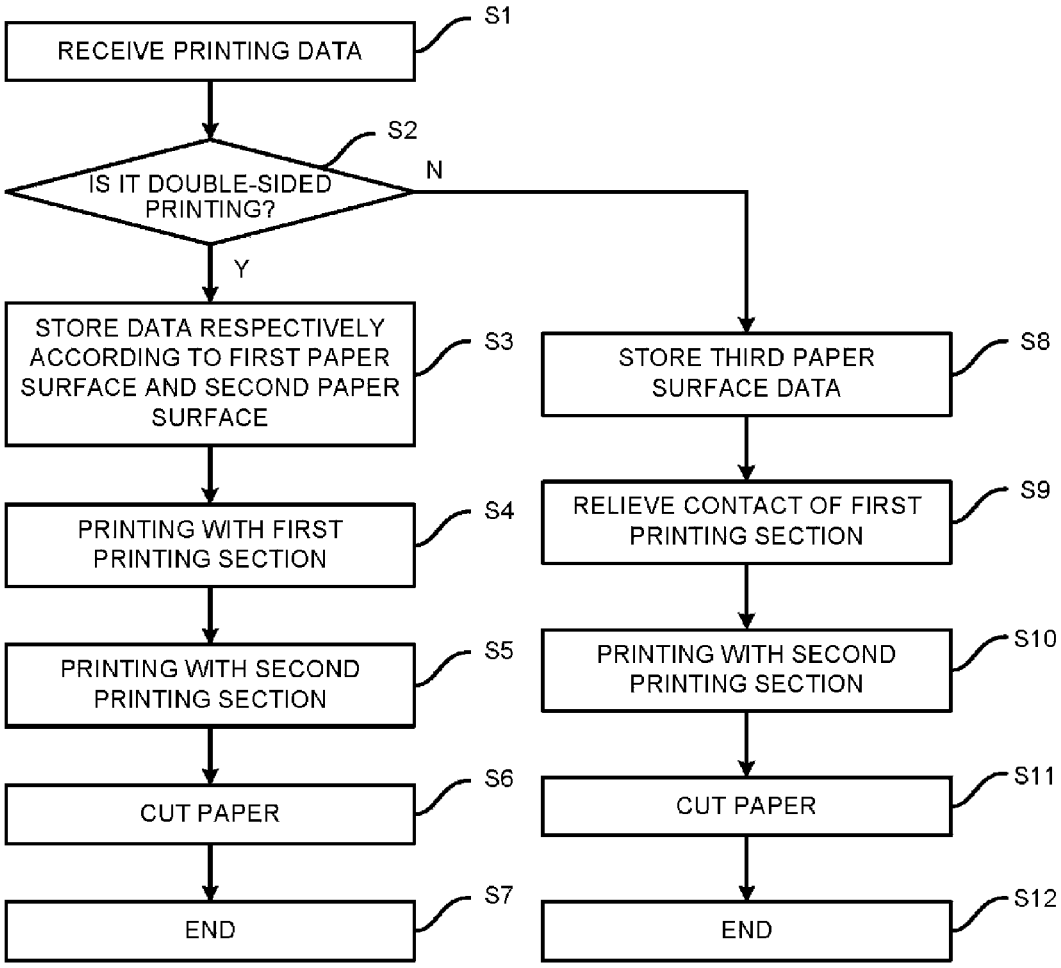
FIG. 7 is a flowchart illustrating the flow of a printing processing in a case where the double-sided paper and single-sided paper involved in the embodiment are loaded.
Figure 8:
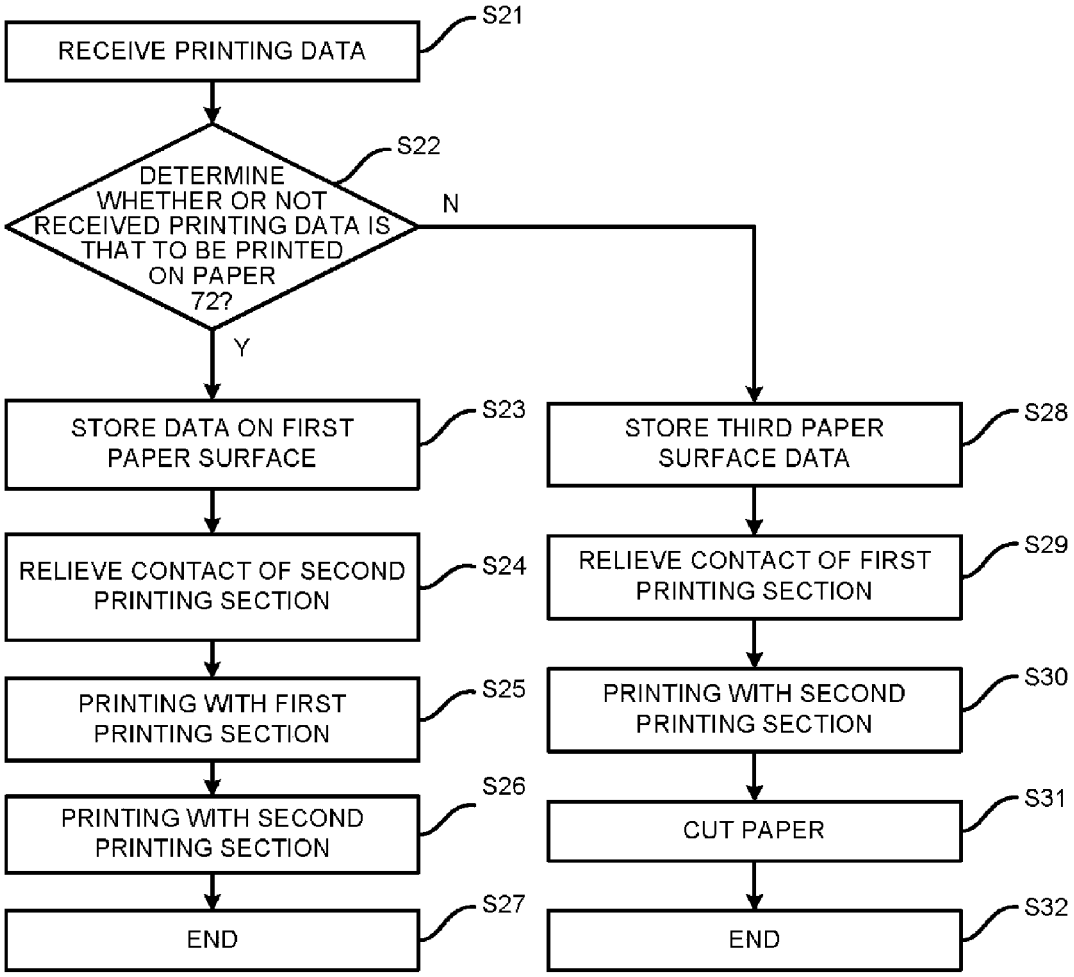
FIG. 8 is a flowchart illustrating the flow of a printing processing in a case where two kinds of single-sided papers involved in the embodiment are loaded.

FIG. 3 is a block diagram illustrating the control section of the printer apparatus 1 and the second conveyance section 30 involved in the embodiment. The control section 50 controls the drive for the printer apparatus 1 and the second conveyance section 30, the conveyance of paper, the printing of paper, the cutoff of paper, the discharging of paper and the display of the condition of the printer apparatus.

The control section 50 consists of a microcomputer which links with a host computer 51 and carries out various controls. The central processor (MPU) 52 of the control section 50 carries out various control and operations such as a paper conveying control, a printing control, a paper cutting control and a paper discharging control.

Further, the MPU 52 comprises a timer 53 serving as a unit for carrying out time setting and time control.

Further, a ROM 54 and a RAM 55 are arranged in the control section 50 as primary memory units for storing the control programs executed by the MPU 52 and the data generated during a control or an operation process.

The ROM 54 is a read-only memory in which control programs and tables are stored, and the RAM 55 is a random access memory in which the data generated during an operation process is stored.

A first paper surface data storage section 66 and a second paper surface data storage section 67 are arranged in the RAM 55 which divide the printing data from the host computer 51 into data to be printed on the first paper surface 6 and data to be printed on the second paper surface 7 and store the data respectively when a printing is performed on the paper 3. Likewise, a third paper surface data storage section 68 for storing the printing data from the host computer 51 when a printing is performed on the third paper surface 33 is arranged in the RAM 55.

An input/output (I/O) unit 56 is arranged in the control section 50 to acquire various input data from the host computer 51 and takes out a control output from the control section 50 to the host computer 51. The I/O 56 is connected with the MPU 52, the ROM 54 and the RAM 55 via a bus line.

The I/O 56 is connected with a first, a second, a third, a fourth, a fifth, a sixth, a seventh, an eighth and a ninth driver 57, 58, 59, 60, 61, 62, 63, 64 and 65 to function as a unit for taking out a control output.

The first driver 57 supplies a necessary drive output for the first printing section 13. The second driver 58 supplies a necessary drive output for the second printing section 16. The third driver 59 supplies a drive output for the conveyance roller 9. The fourth driver 60 supplies a drive output for the cutter 17. The fifth driver 61 supplies a drive output for the discharging roller 18. The sixth driver 62 supplies a display drive output for the display section 21 to carry out various display. The seventh driver 63 supplies a drive signal for the conveyance roller 37. The eighth driver 64 supplies a drive signal for the first contact/separation motor 40. The ninth driver 65 supplies a drive signal for the second contact/separation motor 42.

When the paper 3 is printed by the first printing section 13 and the second printing section 16, the platen roller 12 is rotationally driven by a motor in synchronism with a printing operation based on a control output serving as a printing instruction unit of the MPU 52. The first thermal print head 11 performs printing on the first paper surface 6 of the paper 3 based on the first paper surface data created by the MPU 52 according to the printing data from the host computer 51 and stored in the first paper surface data storage section 66. The second platen roller 15 is rotationally driven by a motor not shown in synchronism with a printing operation based on a control output serving as a printing instruction unit of the MPU 52. The second thermal printing head 14 carries out a printing on the second paper surface 7 of the paper 3 based on the second paper surface printing data created by the MPU 52 and stored in the second paper surface data storage section 67.

When a printing is carried out on the paper 31, the second platen roller 15 is rotationally driven by a motor in synchronism with a printing operation based on a control output serving as a printing instruction unit of the MPU 52. The second thermal printing head 14 carries out a printing on the third paper surface 33 of the paper 31 based on the third paper surface data created by the MPU 52 and stored in the third paper surface data storage section 68.

The MPU 52 of the control section 50 carries out the rotation and stop of the conveyance roller 9 with the driver 59.

The MPU 52 of the control section 50 drives, with the driver 60, the cutter 17 to cut off the paper 3 or the paper 31.

The MPU 52 of the control section 50 carries out the rotation and stop of the discharging roller 18 with the driver 61.

The MPU 52 of the control section 50 displays, with the driver 62, various information, errors and the like of the printer apparatus 1 on the display section 21.

The MPU 52 of the control section 50 carries out the rotation and stop of the conveyance roller 37 with the driver 63.

The MPU 52 of the control section 50 carries out the rotation and stop of the first contact/separation motor 40 with the driver 64.

The MPU 52 of the control section 50 carries out the rotation and stop of the second contact/separation motor 42 with the driver 65.

The operations of the printer apparatus 1 are described below with reference to FIG. 4-FIG. 8.

First, the user loads the second conveyance section 30 in the printer apparatus 1. In this state, the user can print on two kinds of papers, the paper loaded in the printer apparatus 1 and the paper loaded in the second conveyance section 30.

The user loading the second conveyance section 30 in the printer apparatus 1 mainly carries out double-sided printing and occasionally single-sided printing. However, some users desire to use two kinds of single-sided paper. Thus, a mode A shown in FIG. 6 in which double-sided paper is loaded in the printer apparatus 1 and single-sided paper is loaded in the second conveyance section 30 and a mode B shown in FIG. 6 in which single-sided paper is loaded in both the printer apparatus 1 and the second conveyance section 30 are described below. Further, as paper is loaded in the same way in modes A and B, only the paper loading method used in the mode A is described, and that in the mode B is omitted.

(Mode A)

First, the user makes which double-sided paper capable of printing on the first paper surface and the second paper surface is loaded in the printer apparatus 1 and single-sided paper capable of printing only on the third paper surface is loaded in the second conveyance section 30, stored in an operation panel not shown and the like.

Next, the paper 3 wound on the winding shaft 4 is made to rotationally support on a frame not shown arranged in the printer apparatus 1. Then, the user pulls out the paper 3 and positions the front end of the paper 3 at the most upstream between the conveyance roller 9 and the idler roller 10 among the plurality of conveyance rollers 9 and idler rollers 10 after the paper 3 passes through the idler roller 5.

Next, the user makes the paper 31 wound on the winding shaft 32 rotationally supported on a frame not shown arranged in the second conveyance section 30. Then, the user pulls out the paper 31 and positions the front end of the paper 31 at the most upstream between the conveyance roller 37 and the idler roller 38 among the plurality of conveyance rollers 37 and idler rollers 38.

In this state, once a printing data from the host computer 51 is received (S1), the control section 50 determines whether or not the received printing data is double-sided printing data to be printed on two surfaces of paper (S2). Here, after determining that it is double-sided printing data (YES in S2), the control section 50 divides the received printing data into data to be printed on the first paper surface 6 and data to be printed on the second paper surface 7 and stores the data respectively in the first paper surface data storage section 66 and the second paper surface data storage section 67 (S3).

Next, the control section 50 drives the first printing section 13 to print the printing data stored in the first paper surface data storage section 66 on the first paper surface 6 of the paper 3 through a cooperation of the first thermal printing head 11 with the first platen roller 12 (S4).

Then, the control section 50 drives the second printing section 16 to print the printing data stored in the second paper surface data storage section 67 on the second paper surface 7 of the paper 3 through a cooperation of the second thermal printing head 14 with the second platen roller 15 (S5).

It is described here that the second printing section 16 is driven after the first printing section 13. However, the second printing section 16 is not limited to be driven after the first printing section 13. For example, sometimes the second paper surface 7 and the first paper surface 6 of the paper 3 are printed synchronously. Further, when there is a blank at the upper end of the first paper surface 6, the second printing section 16 is driven before the first printing section 13 even if the first paper surface 6 and the second paper surface 7 of the paper 3 are both printed.

After the printing on the paper 3 using the first printing section 13 and the second printing section 16 is completed, the paper 3 is further conveyed to the downstream side and then cut off by the cutter 17 (S6). Then, the printed paper 3 is discharged to the outside of the printer apparatus 1 from the paper discharging port 20 through the cooperation of the discharging roller 18 with the discharging idler roller 19, and then the printing operation is ended (S7).

After determining that the printing data received from the host computer 51 is not double-sided printing data (NO in S2), the control section 50 stores the received printing data in the third paper surface data storage section 68 of the RAM 55 (S8).

Next, the control section 50 drives the first contact/separation motor 40 to relieve the contact of the first thermal printing head 11 with the first platen roller 12 in the first printing section 13 (S9).

FIG. 5 shows an example of a contact and separation mechanism of a thermal printing head and a platen roller.

As shown in FIG. 5(*a*), the first thermal printing head 11 is contacted with the first platen roller 12 via a spring not shown, and the paper 3 pass through between the first thermal printing head 11 and the first platen roller 12. A contact/separation eccentric ring 70 and a contact/separation rotary gear 71 are arranged at an end of the first platen roller 12, the contact/separation eccentric ring 70 having a part having a radius greater than that of the first platen roller 12 and a part having a radius smaller than that of the first platen roller 12; the first platen roller 12 is not fixed with the contact/separation eccentric ring 70 which, however, is fixed with the contact/separation rotary gear 71.

As shown in FIG. 5 (*b*), the contact/separation eccentric ring 70 has a part having a radius q greater than the radius p of the first platen roller 12 and a part having a radius r smaller than the p.

When the printer apparatus 1 carries out a double-sided printing, the first thermal printing head 11 is contacted with the first platen roller 12, and the part of the contact/separation eccentric ring 70 having a small radius r faces the first thermal printing head 11. No influence is caused to the contact as the radius r is smaller than the radius p, further, due to the first platen roller 12 and the contact/separation eccentric ring 70 is not fixed, the contact of the first thermal printing head 11 with the first platen roller 12 is kept.

When the contact of the first thermal printing head 11 with the first platen roller 12 is released, the first contact/separation motor 40 provided with the first contact/separation gear 39 is rotated. The first contact/separation gear 39 is engaged with the contact/separation rotary gear 71 which is further fixed with the contact/separation eccentric ring 70. Thus, the contact/separation eccentric ring 70 becomes rotated once the first contact/separation motor 40 is rotated.

The first contact/separation motor 40 is rotated until the contact/separation rotary gear 71 is in the state rotated by 180 degrees. If the contact/separation rotary gear 71 is rotated by 180 degrees, the part of the contact/separation eccentric ring 70 having a large radius q greater than the radius p of the first platen roller 12 faces the first thermal printing head 11. Thus, the contacted first thermal printing head 11 and the first platen roller 12 are separated to a distance equal to the difference of the radius between the r and p. Further, to achieve the contact again, the first contact/separation motor 40 is rotated by 180 degrees with respect to the state in which the contact/separation rotary gear 71 is separated.

After releasing the contact of the first thermal printing head 11 with the first platen roller 12 (S9), the control section conveys the paper 31 through the cooperation of the conveyance roller 37 with the idler roller 38. The release of the contact of the first thermal printing head 11 with the first platen roller 12 disenables a function of conveying paper based on the contact thereof. However, by means of the conveyance roller 37 arranged at the upstream side of the paper conveyance direction of the first thermal printing head 11 and the idler roller 38 arranged at the downstream side of the paper conveyance direction of the first platen roller 12, the paper 31 is continuously conveyed normally.

The second paper conveyance path 36 connects the first printing section 13 and the second printing section 16 of the first conveyance path 8, and the paper 31 merges with the first paper conveyance path 8 between the first printing section 13 and the second printing section 16 and is then conveyed to the second printing section 16.

Then, the control section 50 drives the second printing section 16 to print the printing data stored in the third paper surface data storage section 68 on the third paper surface 33 through the cooperation of the second thermal printing head 14 with the second platen roller 15 (S10).

The paper 31, after being printed by the second printing section 16, is further conveyed to the downstream side and then cut off by the cutter 17 (S11). Then, the printed paper 31 is discharged to the outside of the printer apparatus 1 from the paper discharging port 20 through the cooperation of the discharging roller 18 with the discharging idler roller 19, and then the printing is ended (S12).

Next, a mode B in which single-sided paper is loaded in both the printer apparatus 1 and the second conveyance section 30 is described. Further, the paper loading method used in the mode B is the same as that used in the mode A, the description is omitted.

First, the user makes which the single-sided papers are loaded in both the printer apparatus 1 and the second conveyance section 30 stored in an operation panel not shown and the like.

In this state, once the printing data from the host computer 51 is received (S21), the control section 50 first determines whether or not the received printing data is printing data to be printed on the paper 72 which is loaded in the printer apparatus 1 and only has a thermosensitive layer on the first paper surface 6 (S22). Further, information for the determination on whether or not the printing data is printing data to be printed on the paper 72 which is loaded in the printer apparatus 1 and only has a thermosensitive layer on the first paper surface 6 is contained in the printing data sent from the host computer 51.

Here, when determined the received printing data is printing data to be printed on the paper 72 loaded in the printer apparatus 1 (YES in S22), the control section 50 stores the received printing data in the first paper surface data storage section 66 (S23).

Then, the control section 50 releases the contact of the second thermal printing head 14 with the second platen roller 15 (S24). Like described above, the release of the contact is carried out by rotating the second contact/separation gear 41 through the rotation of the second contact/separation motor 42 and then rotating the contact/separation rotary gear 71 and the contact/separation eccentric ring 70.

Next, the control section 50 drives the first printing section 13 to print the printing data stored in the first paper surface data storage section 66 on the first paper surface 6 of the paper 72 through the cooperation of the first thermal printing head 11 with the first platen roller 12 (S25).

The paper 72, once printed by the first printing section 13, is further conveyed to the downstream side and then cut off by the cutter 17 (S26). Then, the printed paper 72 is discharged to the outside of the printer apparatus 1 from the paper discharging port 20 through the cooperation of the discharging roller 18 with the discharging idler roller 19, and then the printing is ended (S27).

When determined that the printing data received from the host computer 51 is not data to be printed on the paper 72 loaded in the printer apparatus 1 (NO in S22), the control section 50 stores the received printing data in the third paper surface data storage section 68 of the RAM 55 (S28).

Then, the control section 50 drives the first contact/separation motor 40 to release the contact of the first thermal printing head 11 with the first platen roller 12 in the first printing section 13 (S29). Further, the release method of the contact is the same as which is describe above, and therefore the description is not described here.

After releasing the contact of the first thermal printing head 11 with the first platen roller 12 (S29), the control section 50 conveys the paper 31 through the cooperation of the conveyance roller 37 with the idler roller 38.

The second paper conveyance path 36 connects the first printing section 13 and the second printing section 16 of the first conveyance path 8, and the paper 31 merges with the first paper conveyance path 8 between the first printing section 13 and the second printing section 16 and is then conveyed to the second printing section 16.

Then, the control section 50 drives the second printing section 16 to print the printing data stored in the third paper surface data storage section 68 on the third paper surface 33 through the cooperation of the second thermal printing head 14 with the second platen roller 15 (S30).

The paper 31, once printed by the second printing section 16, is further conveyed to the downstream side and then cut off by the cutter 17 (S31). Sequentially, the printed paper 31 is discharged to the outside of the printer apparatus 1 from the paper discharging port 20 through the cooperation of the discharging roller 18 with the discharging idler roller 19, and then the printing is ended (S32).

In this way, the second conveyance section 30 has a release mechanism for releasing the contact of the first thermal printing head 11 with the first platen roller 12 and a release mechanism for releasing the contact of the second thermal printing head 14 with the second platen roller 15.

For example, it is executable in which a single-sided paper is printed by the first printing section 13 to protect a printing result such as a deposit balance from being seen by others. When printing single-sided paper with a printer apparatus provided with a double-sided printing mechanism, it is worried that the service life of the thermal printing head of a printing section which carries no printing will be shortened by the friction through the contact of the thermal printing head with continuously rotating platen roller or paper. Especially, when there is no paper between the thermal printing head and the platen roller, the friction of the thermal print heading with the platen roller may shorten the service life of the thermal printing head.

The drive for the first printing section 13 at the upstream side of the second printing section 16 may be stopped when the second printing section 16 carries out a single-sided printing. However, the drive for the second printing section 16 at the downstream side of the first printing section 13 cannot be stopped when the first printing section 13 carries out a single-sided printing. Aiming at this, a release mechanism for releasing the contact of the first thermal printing head 11 with the first platen roller 12 and a release mechanism for releasing the contact of the second thermal printing head 14 with the second platen roller 15 are arranged according to the embodiment. The contact of the thermal printing head of a printing section carrying no printing with a platen roller is released, therefore the friction of the thermal printing head with the platen roller may be prevented in the case which there is no printing is implemented.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An additional conveyance mechanism of a printer apparatus is carried on a printer apparatus comprising a first paper conveyance path configured to convey paper having printing surfaces on a first surface and a second surface serving as the backside of the first surface, a first printing section having a thermal printing head for carrying out printing on the first surface and a platen roller contacted with the thermal printing head, and a second printing section which is arranged at the downstream side of the paper conveyance direction of the first printing section having a thermal printing head for carrying out printing on the second surface and a platen roller contacted with the thermal printing head, wherein the additional conveyance mechanism of the printer apparatus comprises: a second paper conveyance path configured to convey papers having only one printing surface in which side it is merged with the first paper conveyance path between the first printing section and the second printing section, and a separation mechanism configured to separate the thermal printing head carrying out no printing from the platen roller in the contacted thermal printing heads and platen rollers when the papers loaded in the printer apparatus and the additional conveyance mechanism of the printer apparatus are printed.

2. A printer apparatus, comprising:

a first paper conveyance path configured to convey paper having printing surfaces on a first surface and a second surface serving as the backside of the first surface;

a first printing section having a thermal printing head for carrying out printing on the first surface and a platen roller contacted with the thermal printing head;

a second printing section which is arranged at the downstream side of the paper conveyance direction of the first printing section having a thermal printing head for carrying out printing on the second surface and a platen roller contacted with the thermal printing head; and an additional conveyance mechanism of the printer apparatus comprising: a second paper conveyance path configured to convey papers having only one printing surface in which side it is merged with the first paper conveyance path between the first printing section and the second printing section, and a separation mechanism configured to separate the thermal printing head from the platen roller carrying out no printing in the contacted thermal printing heads and platen rollers when the printing is being carried out by the first printing section and the second printing section.

3. The printer apparatus according to claim 2, wherein the additional conveyance mechanism of the printer apparatus is arranged above the printer apparatus.

* * * * *